US012054903B2

(12) United States Patent
Hu et al.

(10) Patent No.: US 12,054,903 B2
(45) Date of Patent: Aug. 6, 2024

(54) STRUCTURE FOR SUPPORTING FOUNDATION PIT BASED ON STEEL EDGE-ARCH STRUCTURE

(71) Applicant: Dongtong Geotechnical Science and Technology Inc., Hangzhou (CN)

(72) Inventors: Qi Hu, Hangzhou (CN); Xiaobing Xu, Hangzhou (CN); Xingdi Huang, Hangzhou (CN); Tianming Huang, Hangzhou (CN); Huajian Fang, Hangzhou (CN); Xiang Zhu, Hangzhou (CN); Haidi Zhu, Hangzhou (CN); Tao Wang, Hangzhou (CN); Yiliang Deng, Hangzhou (CN); Zefeng Lou, Hangzhou (CN); Jianping Li, Hangzhou (CN)

(73) Assignee: Dongtong Geotechnical Science and Technology Inc., Hangzhou (CN)

( * ) Notice: Subject to any disclaimer, the term of this patent is extended or adjusted under 35 U.S.C. 154(b) by 209 days.

(21) Appl. No.: 17/876,270

(22) Filed: Jul. 28, 2022

(65) Prior Publication Data

US 2022/0372724 A1 Nov. 24, 2022

(30) Foreign Application Priority Data

Aug. 25, 2021 (CN) ..... 202110982187.X

(51) Int. Cl.
*E02D 17/04* (2006.01)

(52) U.S. Cl.
CPC ..... *E02D 17/04* (2013.01); *E02D 2250/0046* (2013.01); *E02D 2300/0029* (2013.01)

(58) Field of Classification Search
CPC .. E02D 17/02; E02D 17/04; E02D 2300/0029
USPC ..... 52/831
See application file for complete search history.

(56) References Cited

U.S. PATENT DOCUMENTS 3,710,578 A * 1/1973 Inoue ..... E02D 17/04 405/282
4,140,427 A * 2/1979 Jackson ..... E02D 5/28 405/253
4,376,599 A * 3/1983 Krings ..... E02D 17/08 405/282

(Continued)

FOREIGN PATENT DOCUMENTS

CN 203821400 U 9/2014
CN 204112335 U 1/2015

(Continued)

*Primary Examiner* — Paola Agudelo

(57) ABSTRACT

A structure for supporting a foundation pit based on a steel edge-arch structure, including: an enclosing purlin beam, the steel edge-arch structure, a plurality of support beams and a plurality of triangular supports. The support beams are located at an inner side of the enclosing purlin beam. The triangular supports are arranged on the enclosing purlin beam. End portions of the support beams are supported on the enclosing purlin beam through the triangular supports, and abutted on side edges of the triangular supports. The steel edge-arch structure is located between two adjacent triangular supports. The steel edge-arch structure includes two first haunched members and a bracing beam provided therebetween.

10 Claims, 5 Drawing Sheets

(56) References Cited

U.S. PATENT DOCUMENTS

| | | | | |
|---|---|---|---|---|
| 4,453,863 | A * | 6/1984 | Sutton | E02D 17/08 405/282 |
| 4,464,084 | A * | 8/1984 | Wozniak | E02D 17/04 405/151 |
| 7,883,296 | B2 * | 2/2011 | Meyer | E02D 17/04 405/283 |
| 10,392,770 | B2 * | 8/2019 | Chilton | E02D 17/04 |
| 11,236,987 | B2 * | 2/2022 | Derrick | G01B 5/004 |
| 2006/0070803 | A1 * | 4/2006 | Han | E02D 17/04 182/87 |
| 2010/0054869 | A1 * | 3/2010 | Meyer | E02D 17/04 405/282 |
| 2012/0204512 | A1 * | 8/2012 | Trinko | E04G 23/024 254/133 R |
| 2014/0248093 | A1 * | 9/2014 | Breen | E02F 5/10 405/284 |
| 2019/0153693 | A1 * | 5/2019 | Hu | E02D 17/04 |
| 2020/0291597 | A1 * | 9/2020 | Wang | F16L 55/18 |

FOREIGN PATENT DOCUMENTS

| | | | |
|---|---|---|---|
| CN | 109763492 | A | 5/2019 |
| CN | 216615858 | U | 5/2020 |
| CN | 111236263 | A | 6/2020 |
| CN | 211873032 | U | 11/2020 |

* cited by examiner

STRUCTURE FOR SUPPORTING FOUNDATION PIT BASED ON STEEL EDGE-ARCH STRUCTURE

CROSS-REFERENCE TO RELATED APPLICATIONS

This application claims the benefit of priority from Chinese Patent Application No. 202110982187.X, filed on Aug. 25, 2021. The content of the aforementioned application, including any intervening amendments thereto, is incorporated herein by reference in its entirety.

TECHNICAL FIELD

This application relates to a steel support structure of foundation pits, and more particularly to a structure for supporting a foundation pit based on a steel edge-arch structure.

BACKGROUND

A common foundation pit steel support structure includes an enclosing purlin beam, a support beam and a triangular support. The support beam is located on an inner side of the enclosing purlin beam. The triangular support is provided on the enclosing purlin beam, and a base of the triangular support is fixedly provided on the enclosing purlin beam. An end portion of the support beam is supported on the enclosing purlin beam through the triangular support. In such foundation pit steel support structure, the enclosing purlin beam is supported through the cooperation of the support beam and the triangular support, so as to achieve the relatively low-density support of the support beam in the foundation pit, enlarging the working space for excavation of the foundation pit. Unfortunately, the span between two adjacent triangular supports tends to increase, such that the enclosing purlin beam is prone to bending deformation, which is adverse to the mitigation of lateral deformation.

SUMMARY

An objective of this application is to provide a structure for supporting a foundation pit based on a steel edge-arch structure, in which the span of the enclosing purlin beam between two adjacent triangular supports is shortened, without introducing additional triangular supports and increasing the density of the support beams in the foundation pit, so as to mitigate the bending deformation of the enclosing purlin beam and the lateral deformation of the foundation pit.

Technical solutions of this application are described as follows.

This application provides a structure for supporting a foundation pit based on a steel edge-arch structure, comprising:

an enclosing purlin beam;

a plurality of support beams;

a plurality of triangular supports; and the steel edge-arch structure;

wherein the plurality of support beams are located at an inner side of the enclosing purlin beam; the plurality of triangular supports are arranged on the enclosing purlin beam; a base edge of each of the plurality of triangular supports is fixedly provided on the enclosing purlin beam; an end portion of each of the plurality of support beams is supported on the enclosing purlin beam through a corresponding triangular support, and the end portion of each of the plurality of support beams abuts on a side edge of the corresponding triangular support; the steel edge-arch structure is located between two adjacent triangular supports; the two adjacent triangular supports consist of a first triangular support and a second triangular support; the steel edge-arch structure comprises two first haunched members and a bracing beam located between the two first haunched members; one of the two first haunched members is provided between one side edge of the first triangular support and the enclosing purlin beam, and the other side edge of the first triangular support abuts against an end portion of a corresponding support beam; the other of the two first haunched members is provided between one side edge of the second triangular support and the enclosing purlin beam, and the other side edge of the second triangular support abuts against an end portion of a corresponding support beam; and one side of each of the two first haunched members is connected to the side edge of each of the two adjacent triangular supports, and the other side of each of the two first haunched members is connected to the enclosing purlin beam; one end of the bracing beam abuts on one of the two first haunched members, and the other end of the bracing beam abuts on the other of the two first haunched members.

The steel edge-arch structure installs the first haunched member between the side edge of the triangular support and the enclosing purlin beam to enlarge the control range of the triangular support and reduce a span of the enclosing purlin beam between the two adjacent triangular supports, so as to mitigate the bending deformation of the enclosing purlin beam and the lateral deformation of the foundation pit. The bracing beam is provided between the two first haunched members to further enlarge the control range of the steel edge-arch structure, so as to further mitigate the bending deformation of the enclosing purlin beam and the lateral deformation of the foundation pit. Thus, the span of the enclosing purlin beam between the two adjacent triangular supports can be shortened without adding more triangular supports and increasing the density of the support beams in the foundation pit, so as to mitigate the bending deformation of the enclosing purlin beam and the lateral deformation of the foundation pit. At the same time, the bracing beam and the enclosing purlin beam are combined to further enhance the bending stiffness and bending strength of the enclosing purlin beam, so as to allow the enclosing purlin beam 1 to resist greater soil pressure.

In an embodiment, the two first haunched members each have a triangular structure. One side edge of each of the two first haunched members is connected to the side edge of one of the plurality of triangular supports, and the other side edge of each of the two first haunched members is connected to the enclosing purlin beam. Compared with the prior art, the included angle (the included angle is an obtuse angle) between a base edge of each of the two first haunched members and the enclosing purlin beam is enlarged, such that an outside edge angle is enlarged to further reduce the stress concentration between each of the two haunched members and the enclosing purlin beam, improving the local yield resistance of the two first haunched members and the enclosing purlin beam.

In an embodiment, a base angle of each of the two first haunched members close to the bracing beam is truncated to form a supporting surface; and an end surface of the bracing beam abuts on the supporting surface, so as to improve the stability of the bracing beam provided between the two first haunched members.

In an embodiment, the supporting surface is an inclined surface; a side of the supporting surface away from the enclosing purlin beam is inclined toward the bracing beam; and the end surface of the bracing beam abutting on the supporting surface is also an inclined surface. In the structure for supporting the foundation pit, the plurality of triangular supports are subjected to horizontal shear force along the enclosing purlin beam, due to the action of external soil pressure, such that the displacement of the plurality of triangular supports may occur during the long-term operation of the structure for supporting the foundation pit. When the displacement of the plurality of triangular supports along the enclosing purlin beam occurs, the two triangular supports respectively provided at two ends of the bracing beam approaches to each other. Since the supporting surface is an inclined surface, and the side of the supporting surface away from the enclosing purlin beam is inclined toward the bracing beam, the external soil pressure is transmitted to the bracing beam through the supporting surface of each of the two first haunched members, and the bracing beam is driven to apply the opposite pressure to the outside of the foundation pit, thereby mitigating the bending deformation of the enclosing purlin beam and the lateral deformation of the foundation pit.

In an embodiment, at least one of the plurality of support beams comprises two inclined support beams distributed in a splayed manner; an end portion of one of the two inclined support beams close to the enclosing purlin beam abuts on a first side edge of the first triangular support, so as to be supported on the enclosing purlin beam; an end portion of the other of the two inclined support beams close to the enclosing purlin beam abuts on a second side edge of the second triangular support, so as to be supported on the enclosing purlin beam;

a second haunched member is provided between a second side edge of the first triangular support and the enclosing purlin beam, and a third haunched member is provided between a first side edge of the second triangular support;

one side of the second haunched member is connected to the second side edge of the first triangular support, and the other side of the second haunched member is connected to the enclosing purlin beam; one side of the third haunched member is connected to the first side edge of the second triangular support, and the other side of the third haunched member is connected to the enclosing purlin beam. The second haunched member is installed between the second side edge of the first triangular support and the enclosing purlin beam to enlarge the control range, and reduce a span of the enclosing purlin beam between the adjacent two triangular supports, so as to mitigate the bending deformation of the enclosing purlin beam and the lateral deformation of the foundation pit.

In an embodiment, the first triangular support and the second triangular support are located between the second haunched member and the third haunched member; the second haunched member is connected to the third haunched member through a prestressed cable; and the prestressed cable is configured to apply a pretension between the second haunched member and the third haunched member. In the structure for supporting the foundation pit, the first triangular support and the second triangular support respectively corresponding to the two inclined support beams are subjected to horizontal shear force along the enclosing purlin beam, due to the action of external soil pressure, such that the displacement of the two triangular supports may occur along the enclosing beam or the deformation of the connection between the two triangular supports and the enclosing purlin beam, leading to lateral deformation of the foundation pit during the long-term operation of the support structure. The enclosing purlin beam between the first triangular support and the second triangular support respectively corresponding to the two inclined support beams are subjected to the external soil pressure, such that the enclosing purlin beam is prone to bending deformation. In order to overcome the above-mentioned problems, the second haunched member and the third haunched member are connected to each other through a prestressed cable. The prestressed cable is configured to apply pretension force between the second haunched member connected to the first triangular support and the third haunched member connected to the second triangular support, such that part of the horizontal shear force applied to the first triangular support and the second triangular support along the enclosing purlin beam are counteracted. At the same time, the prestressed cable and the bolts between the two triangular supports and the enclosing purlin beam are configured to bear the horizontal shear force applied to the two triangular supports along the enclosing purlin beam, so as to effectively improve the lateral deformation of the foundation pit caused by the displacement of the triangular supports along the enclosing purlin beam or the deformation of the connection between the triangular supports and the enclosing purlin beam. Considering that the prestressed cable 6 applies the pretension force between the second haunched member connected to the first triangular support and the third haunched member connected to the second triangular support, the reverse arch force is generated by the enclosing purlin beam between the two triangular supports, so as to further enhance the bearing capacity of the enclosing purlin beam between the two triangular supports, thereby mitigating the bending deformation of the enclosing purlin beam caused by the external soil pressure applied to the enclosing purlin beam between the first triangular support and the second triangular support respectively corresponding to the two inclined support beams.

In an embodiment, the prestressed cable comprises a plurality of prestressed cables; one part of the plurality of prestressed cables is provided above the first triangular support and the second triangular support, and the other part of the plurality of prestressed cables is provided below the first triangular support and the second triangular support respectively corresponding to the two inclined support beams.

In an embodiment, the two first haunched members each have an integrated structure; or the two first haunched members are each formed by two or more components, and any two adjacent components are boltedly connected.

In an embodiment, the second haunched member and the third haunched member each have an integrated structure; or the second haunched member and the third haunched member are each formed by two or more components, and any two adjacent components are boltedly connected.

In an embodiment, one side edge of each of the two first haunched members is boltedly connected to the side edge of each of the two triangular supports, and the other side of each of the two first haunched members is boltedly connected to the enclosing purlin beam, facilitating assembly and disassembly of the two first haunched members.

In an embodiment, one side of the second haunched member is boltedly connected to the second side edge of the first triangular support, and the other side of the second haunched member is boltedly connected to the enclosing purlin beam. One side of the third haunched member is boltedly connected to the first side edge of the second triangular support, and the other side of the third haunched member is boltedly connected to the enclosing purlin beam. The above arrangement facilitates the assembly and disassembly of the two second haunched members.

In an embodiment, the bracing beam is boltedly connected to the enclosing purlin beam.

In an embodiment, the plurality of triangular supports are made of steel.

In an embodiment, the plurality of support beams and the first haunched member are made of steel.

Compared with the prior art, this application has the following beneficial effects.

The supporting structure provided herein can shorten the span of the enclosing purlin beam between two adjacent triangular supports, without introducing additional triangular supports and increasing the density of the support beams in the foundation pit, so as to mitigate the bending deformation of the enclosing purlin beam and the lateral deformation of the foundation pit.

Figure 1:
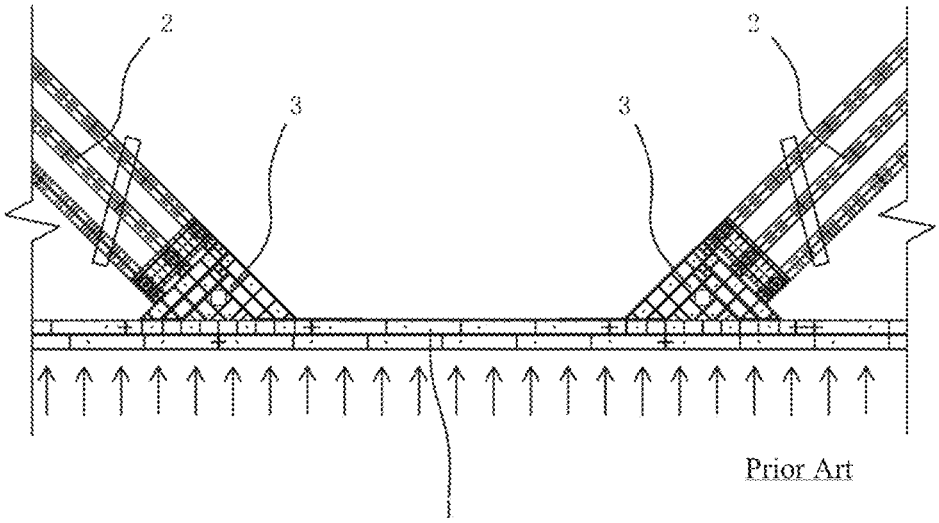
FIG. 1 schematically shows a partial structure of a foundation pit steel support structure in the prior art.

In the drawings, 1, enclosing purlin beam;

2, support beam; 2.0, main support beam; 2.1, inclined support beam; 2.2, steel triangular member;

3, triangular support;

4, steel edge-arch structure; 4.1, first haunched member; 4.2 bracing beam; 4.3 supporting surface;

5, second haunched member; and

6, prestressed cable.

DETAILED DESCRIPTION OF EMBODIMENTS

In order to make the objectives, technical solutions, and beneficial effects of this disclosure clearer, this disclosure will be described in detail below with reference to the accompanying drawings in the embodiments of the disclosure. Obviously, described below are merely some embodiments of the disclosure, which are not intended to limit the disclosure. Based on the embodiments in the disclosure, other embodiments obtained by those of ordinary skill in the art without paying creative effort shall fall within the scope of the present disclosure defined by the appended claims.

The embodiments of this disclosure will be described below in detail with reference to the accompanying drawings. It should be understood that the same or similar reference numerals refer to the same or similar components or components with the same or similar functions throughout the disclosure. The embodiments described below are only illustrative of the technical solutions, and are not intended to limit this disclosure.

With reference to the following descriptions and accompanying drawings, the embodiments will be clearly illustrated, some specific implementations of the embodiments of this disclosure are disclosed in detail to explain the principles of this disclosure, but are not intended to limit this disclosure. It should be understood that any changes, modifications and replacements made by those skilled in the art without departing from the spirit of the disclosure shall fall within the scope of the disclosure defined by the appended claims.

It should be noted that as used herein, terms, such as "thickness", "upper", "lower", "horizontal", "top", "bottom", "inner", "outer", "circumferential", etc., indicate the orientation or positional relations based on the orientation or positional relations shown in the accompanying drawings, which are merely intended to describe this disclosure and simplify the description, instead of indicating or implying that the referred device or component must have a specific orientation, or be constructed or operated in a specific orientation, and thus, it should not be understood as a limitation of this disclosure. In this disclosure, "multiple" indicates at least two, such as two, three, etc., and unless otherwise specified, the "a plurality of" indicates one or more.

Unless otherwise specified, the terms used herein, such as "installed", "connected", "fixed", etc., should be understood broadly, for example, it can be a fixed connection, a detachable connection, or an integrated structure; it can be a mechanical connection, an electrical connection or an electrical communication with each other; it can be a direct connection or an indirect connection through intermediate mediums; it can be an internal connection of two components or the interaction relationship between the two components, unless otherwise specified. For those of ordinary skill in the art, the specific meanings of the above terms used herein can be understood according to specific situations.

FIG. 1 schematically shows a partial structure of a foundation pit steel support structure in the prior art.

Embodiment 1

Figure 2:
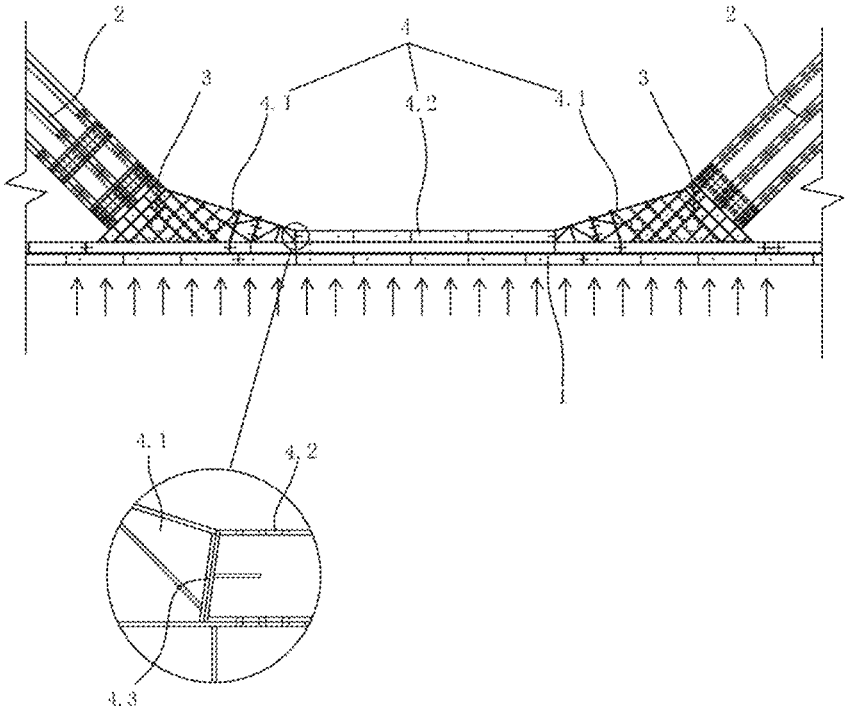
FIG. 2 schematically shows a partial structure of a structure for supporting a foundation pit based on a steel edge-arch structure according to Embodiment 1 of this disclosure.
Figure 3:
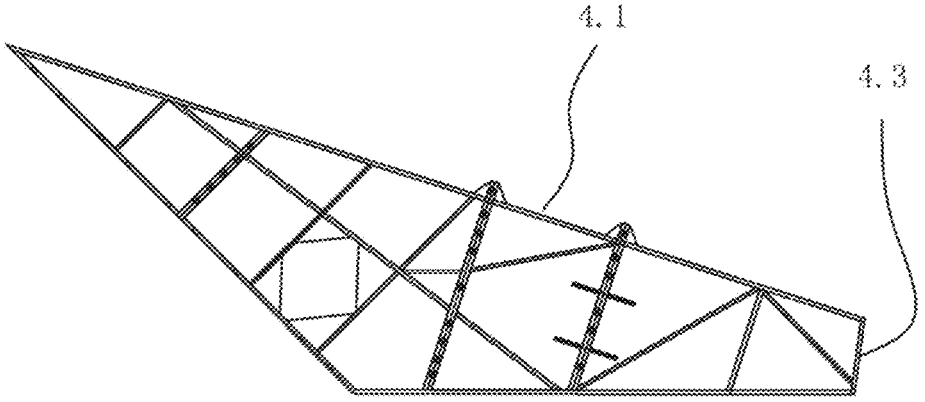
FIG. 3 is a structural diagram of a first haunched member according to Embodiment 1 of this disclosure.

Referring to an embodiment shown in FIGS. 2 and 3, a structure for supporting a foundation pit based on a steel edge-arch structure is provided, which includes an enclosing purlin beam 1, a plurality of support beams 2 and a plurality of triangular supports 3 and the steel edge-arch structure 4. The plurality of support beams 2 are located at an inner side of the enclosing purlin beam 1. The plurality of triangular supports 3 are arranged on the enclosing purlin beam 1. A base edge of each of the plurality of triangular supports 3 is fixedly provided on the enclosing purlin beam 1. In this embodiment, the base edge of each of the plurality of triangular supports 3 is boltedly connected to the enclosing purlin beam 1. An end portion of each of the plurality of support beams 2 is supported on the enclosing purlin beam 1 through a corresponding triangular support 3, for example, two end portions of the support beam 2 are respectively supported on the enclosing purlin beam 1 through the corresponding triangular supports 3; or one end portion of the support beam 2 is supported on the enclosing purlin beam 1 through a corresponding triangular support 3, and the other end portion of the support beam 2 directly abuts on the enclosing purlin beam 1.

The steel edge-arch structure 4 is located between two adjacent triangular supports 3. The two adjacent triangular supports 3 consist of a first triangular support and a second triangular support. The steel edge-arch structure includes two first haunched members 4.1 and a bracing beam 4.2 provided between the two first haunched members 4.1. One of the two first haunched members 4.1 is provided between one side edge of the first triangular support and the enclosing purlin beam 1, and the other side edge of the first triangular support abuts against an end portion of a corresponding support beam. The other the two first haunched members 4.1 is provided between one side edge of the second triangular support and the enclosing purlin beam 1, and the other side edge of the second triangular support abuts against an end portion of a corresponding support beam. One side of each of the two first haunched members 4.1 is connected to a side edge of each of the two adjacent triangular supports, and the other side of each of the two first haunched members 4.1 is connected to the enclosing purlin beam 1. One end of the bracing beam abuts on one of the two first haunched members 4.1, and the other end of the bracing beam abuts on the other of the two first haunched members 4.1.

In this embodiment, one side of each of the two first haunched members 4.1 is boltedly connected to a side edge of the triangular support, and the other side of each of the two first haunched members 4.1 is boltedly connected to the enclosing purlin beam 1. In this embodiment, one side of each of the two first haunched members 4.1 is configured to be welded to the side edge of the triangular support, and the other side of each of the two first haunched members 4.1 is configured to be welded to the enclosing purlin beam 1.

The two first haunched members 4.1 are made of steel. The two first haunched members are each have an integrated structure, or formed by two or more components, and any two adjacent components are boltedly connected. A ribbed plate is provided inside each of the two first haunched members 4.1 to improve the strength of each of the two first haunched members 4.1.

The bracing beam 4.2 is boltedly connected to the enclosing purlin beam 1. Two end portions of bracing beam 4.2 are respectively boltedly connected to the two first haunched members 4.1.

The enclosing purlin beam 1, the plurality of support beams 2, the plurality of triangular supports 3, the two first haunched members 4.1 and the bracing beam 4.2 are all steel components.

In this embodiment, the steel edge-arch structure 4 installs the two first haunched members 4.1 between the side edge of each of the triangular supports 3 and the enclosing purlin beam 1 to enlarge the control range of the triangular supports 3 and reduce a span of the enclosing purlin beam 1 between the adjacent two triangular supports 3, so as to mitigate the bending deformation of the enclosing purlin beam 1 and the lateral deformation of the foundation pit. The bracing beam is provided between the two first haunched members 4.1 to further enlarge the control range of the steel edge-arch structure 4, so as to further mitigate the bending deformation of the enclosing purlin beam 1 and the lateral deformation of the foundation pit. Thus, the span of the enclosing purlin beam 1 between the two adjacent triangular supports 3 can be shortened without introducing additional triangular supports and increasing the density of the support beams in the foundation pit, so as to mitigate the bending deformation of the enclosing purlin beam 1 and the lateral deformation of the foundation pit. At the same time, the bracing beam 4.2 and the enclosing purlin beam 1 are combined to further enhance the bending stiffness and bending strength of the enclosing purlin beam 1, so as to allow the enclosing purlin beam 1 to resist greater soil pressure.

In this embodiment, as shown in FIGS. 2 and 3, the two first haunched members 4.1 each have a triangular structure. One side edge of each of the two first haunched members 4.1 is connected to one side edge of the triangular support 3, and the other side edge of each of the two first haunched members 4.1 is connected to the enclosing purlin beam 1. Compared with the prior art, the included angle (the included angle is an obtuse angle) between a base edge of each of the two first haunched members 4.1 and the enclosing purlin beam 1 is enlarged, such that an outside edge angle is enlarged to further reduce the stress concentration between each of the two haunched members 4.1 and the enclosing purlin beam 1, improving the local yield resistance of the two first haunched members 4.1 and the enclosing purlin beam 1.

In this embodiment, as shown in FIGS. 2 and 3, a base angle of each of the two first haunched members 4.1 close to the bracing beam is truncated to form a supporting surface 4.3. An end portion of the bracing beam 4.2 is abuts on the supporting surface, so as to improve the stability of the bracing beam 4.2 provided between the two first haunched members 4.1.

The supporting surface 4.3 is an inclined surface. A side of the supporting surface away from the enclosing purlin beam 1 is inclined toward the bracing beam 4.2. An end surface of the bracing beam 4.2 abutting on the supporting surface 4.3 is also an inclined surface. In the structure for supporting the foundation pit, the plurality of triangular supports 3 are subjected to horizontal shear force along the enclosing purlin beam 1, due to the action of external soil pressure, such that the displacement of the plurality of triangular supports 3 may occur during the long-term operation of the structure for supporting the foundation pit. When the displacement of the plurality of triangular supports 3 along the enclosing purlin beam 1 occurs, the two triangular supports respectively provided at two end portions of the bracing beam 4.2 approaches to each other. Since the supporting surface 4.3 is an inclined surface, and the side of the supporting surface away from the enclosing purlin beam 1 is inclined toward the bracing beam 4.2, the external soil pressure is transmitted to the bracing beam 4.2 through the supporting surface 4.3 of each of the two first haunched members 4.1, and the bracing beam 4.2 is driven to apply the opposite pressure to the outside of the foundation pit, thereby mitigating the bending deformation of the enclosing purlin beam 1 and the lateral deformation of the foundation pit.

Embodiment 2

Referring to Embodiment 1 for the description of the same or similar part, and the structural differences between Embodiment 2 and Embodiment 1 are specifically described as follows.

Figure 4:
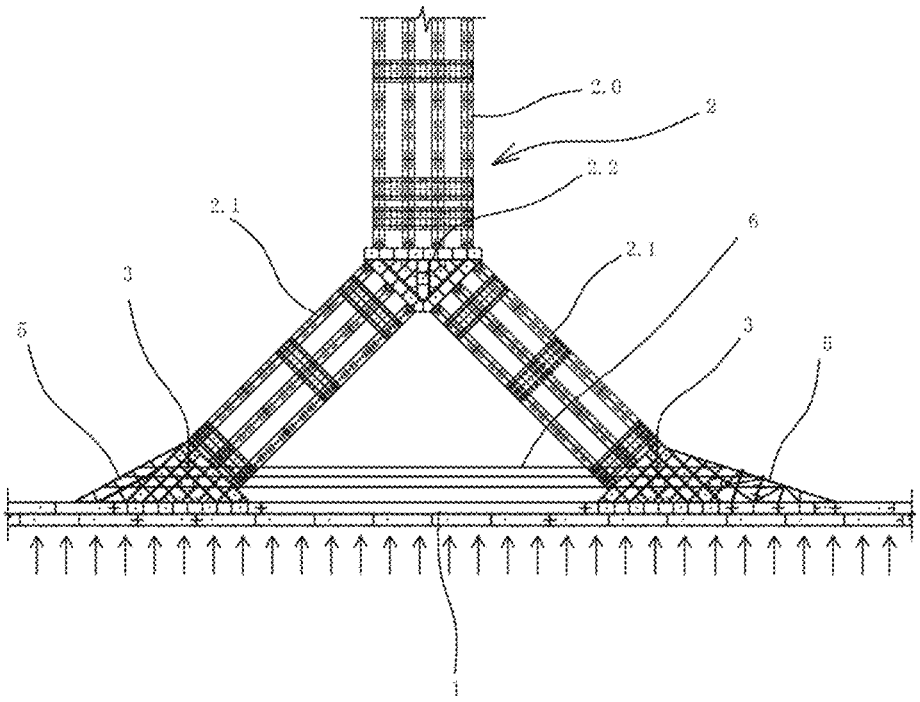
FIG. 4 schematically shows a partial structure of a structure for supporting a foundation pit based on a steel edge-arch structure according to Embodiment 2 of this disclosure.
Figure 5:
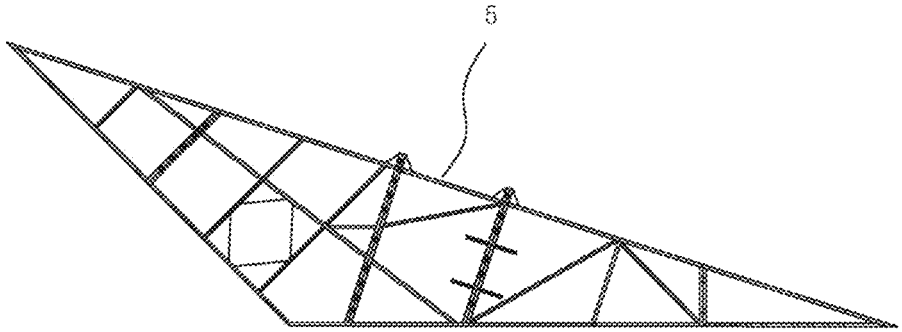
FIG. 5 is a structural diagram of a second haunched member according to Embodiment 2 of this disclosure.

Referring to an embodiment shown in FIGS. 4 and 5, part of the plurality of support beams 2 includes two inclined support beams 2.1. The two inclined support beams 2.1 are distributed in a splayed manner. The two inclined support beams 2.1 are arranged symmetrically. An end portion of one of the two inclined support beams close to the enclosing purlin beam abuts on a first side edge of the first triangular support to be supported on the enclosing purlin beam 1. An end portion of the other of the two inclined support beams close to the enclosing purlin beam abuts on a second side edge of the second triangular support to be supported on the enclosing purlin beam 1. One of two second haunched members 5 is provided between a second side edge of the first triangular support and the enclosing purlin beam 1, and the other of the two second haunched members 5 is provided between a first side edge of the second triangular support and the enclosing purlin beam 1. One side of each of the two second haunched members 5 is connected to the other side edge of each of the two triangular supports 3, and the other side of each of the two second haunched members 5 is connected to the enclosing purlin beam 1.

In this embodiment, one side of the second haunched member 5 is boltedly connected to the other side edge of the triangular support 3, and the other side of the second haunched member 5 is boltedly connected to the enclosing purlin beam 1. One side of the second haunched member 5 is configured to be welded to the other side edge of the triangular support 3, and the other side of the second haunched member 5 is welded to the enclosing purlin beam 1.

The second haunched member 5 is made of steel. The second haunched member 5 has an integrated structure, or formed by two or more components, and any two adjacent components are boltedly connected. A ribbed plate is provided inside the second haunched member 5 to improve the strength of the second haunched member 5.

In this embodiment, the second haunched member 5 is installed between the other side edge of the triangular support 3 and the enclosing purlin beam 1 to enlarge the control range of the triangular support 3, and reduce a span of the enclosing purlin beam 1 between the adjacent two triangular supports 3, so as to mitigate the bending deformation of the enclosing purlin beam 1 and the lateral deformation of the foundation pit.

In this embodiment, as shown in FIG. 4, the plurality of support beams 2 further includes a main support beam 2.0 and two steel triangular members 2.2 installed at two ends of the main support beam 2.0. The base edge of each of the two steel triangular members 2.2 is boltedly connected to the each of two ends of the main support beam 2.0. The two ends of the main support beam 2.0 are respectively arranged with two inclined support beams 2.1 distributed in a splayed manner. The end of each of the two inclined support beams 2.1 close to the enclosing purlin beam 1 is supported on the enclosing purlin beam 1 through the corresponding triangular support 3, and the end of each the two inclined support beams 2.1 close to the main support beam 2.0 abuts on a side edge of the corresponding steel triangular member 2.2 provided at the end of the main support beam 2.0.

In this embodiment, as shown in FIG. 4, the two triangular supports 3 corresponding to the two inclined support beams 2.1 are located between two second haunched members 4 connected to the two triangular supports 3. The two second haunched members 4 connected to the two triangular supports 3 are connected to each other through a prestressed cable 6. The prestressed cable 6 applies pretension force between the two second haunched members 5 connected with the two triangular supports 3. In this embodiment, the two triangular supports 3 refer to the two triangular supports 3 corresponding to the two inclined support beams 2.1. In the structure for supporting the foundation pit, the two triangular supports 3 corresponding to the two inclined support beams 2.1 are subjected to horizontal shear force along the enclosing purlin beam 1, due to the action of external soil pressure, such that the displacement of the two triangular supports 3 may occur or the deformation of the connection between the two triangular supports 3 and the enclosing purlin beam 1, leading to lateral deformation of the foundation pit during the long-term operation of the structure for supporting the foundation pit. The enclosing purlin beam 1 between the two triangular supports 3 corresponding to the two inclined support beams 2.1 are subjected to the external soil pressure, such that the bending deformation of enclosing purlin beam 1 is prone to occur. In order to overcome the above-mentioned problems, the two second haunched members 5 connected to the two triangular supports 3 corresponding to the two inclined support beams 2.1 are connected to each other through a prestressed cable 6. The prestressed cable 6 applies pretension force between the two second haunched members 5 connected with the two triangular supports 3, such that part of the horizontal shear force applied to the two triangular supports 3 along the enclosing purlin beam 1 are counteracted. At the same time, the prestressed cable 6 and the bolts between the triangular supports 3 and the enclosing purlin beam 1 are configured to bear the horizontal shear force applied to the triangular supports 3 along the enclosing purlin beam 1, so as to effectively improve the lateral deformation of the foundation pit caused by the displacement of the triangular supports 3 along the enclosing purlin beam 1 or the deformation of the connection between the triangular supports 3 and the enclosing purlin beam 1. Considering that the prestressed cable 6 applies the pretension force between the second haunched members 5 connected by the two triangular supports 3, the reverse arch force is generated by the enclosing purlin beam 1 between the two triangular supports 3, so as to further enhance the bearing capacity of the enclosing purlin beam 1 between the two triangular supports 3, thereby mitigating the bending deformation of the enclosing purlin beam 1 caused by the external soil pressure applied to the enclosing purlin beam 1 between the two triangular supports 3 corresponding to the two inclined support beams 2.1.

In this embodiment, as shown in FIG. 4, the prestressed cable 6 comprises a plurality of prestressed cables. One part of the plurality of prestressed cables is provided above the first triangular support and the second triangular support respectively corresponding to the two inclined support beams 2.1, and the other part of the plurality of prestressed cables is provided below the first triangular support and the second triangular support respectively corresponding to the two inclined support beams 2.1.

In this embodiment, as shown in FIG. 5, the second haunched member 5 has a triangular structure. One side edge of the second haunched member 5 is connected to one side edge of the triangular support 3, and the other side edge of the second haunched member 5 is connected to the enclosing purlin beam 1. Compared with the prior art, the included angle (the included angle is an obtuse angle) between a base edge of the second haunched member 5 and the enclosing purlin beam is enlarged, such that an outside edge angle is enlarged to further reduce the stress concentration between the second haunched member 5 and the enclosing purlin beam 1, strengthening the local yield resistance of the second haunched members 5 and the enclosing purlin beam 1.

Described above are merely preferred embodiments of the present application, which are not intended to limit the present application. It should be understood that any modifications, replacements and changes made by those skilled in the art without departing from the spirit of the application should still fall within the scope of the present application defined by the appended claims.

What is claimed is:

1. A structure for supporting a foundation pit based on a steel edge-arch structure, comprising:

an enclosing purlin beam;

a plurality of support beams;

a plurality of triangular supports; and the steel edge-arch structure;

wherein the plurality of support beams are located at an inner side of the enclosing purlin beam; the plurality of triangular supports are arranged on the enclosing purlin beam; a base edge of each of the plurality of triangular supports is fixedly provided on the enclosing purlin beam; an end portion of each of the plurality of support beams is supported on the enclosing purlin beam through a corresponding triangular support, and the end portion of each of the plurality of support beams abuts on a side edge of the corresponding triangular support; the steel edge-arch structure is located between two adjacent triangular supports; the two adjacent triangular supports consist of a first triangular support and a second triangular support; the steel edge-arch structure comprises two first haunched members, and a bracing beam located between the two first haunched members; one of the two first haunched members is provided between one side edge of the first triangular support and the enclosing purlin beam, and the other side edge of the first triangular support abuts against an end portion of a corresponding support beam; the other of the two first haunched members is provided between one side edge of the second triangular support and the enclosing purlin beam, and the other side edge of the second triangular support abuts against an end portion of a corresponding support beam; and one side of each of the two first haunched members is connected to a side edge of each of the two adjacent triangular supports, and the other side of each of the two first haunched members is connected to the enclosing purlin beam; one end of the bracing beam abuts on one of the two first haunched members, and the other end of the bracing beam abuts on the other of the two first haunched members.

2. The structure of claim 1, wherein the two first haunched members each have a triangular structure; one side edge of each of the two first haunched members is connected to the side edge of each of the two adjacent triangular supports, and the other side edge of each of the two first haunched members is connected to the enclosing purlin beam.

3. The structure of claim 1, wherein a base angle of each of the two first haunched members close to the bracing beam is truncated to form a supporting surface; and an end surface of the bracing beam abuts on the supporting surface.

4. The structure of claim 3, wherein the supporting surface is an inclined surface;

a side of the supporting surface away from the enclosing purlin beam is inclined toward the bracing beam; and the end surface of the bracing beam abutting on the supporting surface is also an inclined surface.

5. The structure of claim 1, wherein at least one of the plurality of support beams comprises two inclined support beams distributed in a splayed manner; an end portion of one of the two inclined support beams close to the enclosing purlin beam abuts on a first side edge of the first triangular support, so as to be supported on the enclosing purlin beam; an end portion of the other of the two inclined support beams close to the enclosing purlin beam abuts on a second side edge of the second triangular support, so as to be supported on the enclosing purlin beam;

a second haunched member is provided between a second side edge of the first triangular support and the enclosing purlin beam, and a third haunched member is provided between a first side edge of the second triangular support;

one side of the second haunched member is connected to the second side edge of the first triangular support, and the other side of the second haunched member is connected to the enclosing purlin beam; one side of the third haunched member is connected to the first side edge of the second triangular support, and the other side of the third haunched member is connected to the enclosing purlin beam.

6. The structure of claim 5, wherein the first triangular support and the second triangular support are located between the second haunched member and the third haunched member; the second haunched member is connected to the third haunched member through a prestressed cable; and the prestressed cable is configured to apply a pretension force between the second haunched member and third haunched member.

7. The structure of claim 6, wherein the prestressed cable comprises a plurality of prestressed cables; one part of the plurality of prestressed cables is provided above the first triangular support and the second triangular support respectively corresponding to the two inclined support beams, and the other part of the plurality of prestressed cables is provided below the first triangular support and the second triangular support respectively corresponding to the two inclined support beams.

8. The structure of claim 1, wherein the bracing beam is boltedly connected to the enclosing purlin beam.

9. The structure of claim 1, wherein the two first haunched members each have an integrated structure; or the two first haunched members are each formed by two or more components, and any two adjacent components are boltedly connected.

10. The structure of claim 5, wherein the second haunched member and the third haunched member each have an integrated structure; or the second haunched member and the third haunched member are each formed by two or more components, and any two adjacent components are boltedly connected.

* * * * *